US005150558A

United States Patent [19]

Bernhard

[11] Patent Number: 5,150,558

[45] **Date of Patent: * Sep. 29, 1992**

[54] CLOSING MECHANISM FOR A CAPPING MACHINE

[75] Inventor: Herbert Bernhard, Wolfsheim, Fed. Rep. of Germany

[73] Assignee: SEITZ ENZINGER NOLL Maschinenbau Aktiengesellschaft, Mannheim, Fed. Rep. of Germany

[ * ] Notice: The portion of the term of this patent subsequent to Aug. 20, 2008 has been disclaimed.

[21] Appl. No.: 726,387

[22] Filed: Jul. 5, 1991

[30] Foreign Application Priority Data

Jul. 10, 1990 [DE] Fed. Rep. of Germany ..... 4021959
May 10, 1991 [DE] Fed. Rep. of Germany ..... 4115285

[51] Int. Cl.[5] ..... B65B 7/28; B65B 55/24

[52] U.S. Cl. ..... 53/167; 53/343; 53/359

[58] Field of Search ..... 53/167, 282, 306, 308, 53/342, 343, 328, 359, 510; 141/90, 91

[56] References Cited

U.S. PATENT DOCUMENTS 3,308,604 3/1967 Nekola ..... 53/343
3,889,451 6/1975 Burkhardt ..... 53/342
4,205,502 6/1980 Ahlers ..... 53/343 X
4,389,833 6/1983 Knabe ..... 53/342 X
4,527,377 7/1985 Hayashi et al. ..... 53/167
4,602,473 7/1986 Hayashi et al. ..... 53/510
5,040,354 8/1991 Ahlers et al. ..... 53/167

*Primary Examiner*—John Sipos
*Assistant Examiner*—Linda B. Johnson
*Attorney, Agent, or Firm*—Robert W. Becker & Associates

[57] ABSTRACT

A closing mechanism for a capping machine for closing bottles via crown caps or similar closures. The closing mechanism is disposed over a bottle support and, in a vertical axis, can be lowered out of a starting position and returned thereto. A deformation member is provided for placing a closure upon the mouth of the bottle and for subsequently fixing the closure thereon via deformation of the closure while simultaneously pressing the closure against the mouth. A hold-down mechanism extends centrally through the deformation member and is spring-loaded via at least one spring. The hold-down mechanism is displaceable by a prescribed stroke in the vertical direction relative to a closure part that cooperates with the spring. For a CIP cleaning, openings are provided in the region of the hold-down surface for supplying and withdrawing a cleaning or rinsing fluid. At least one of these openings is connected via a channel that extends through the hold-down mechanism to a connector that is provided in the region of that end of the hold-down mechanism remote from the hold-down surface thereof.

26 Claims, 4 Drawing Sheets

CLOSING MECHANISM FOR A CAPPING MACHINE

BACKGROUND OF THE INVENTION

The present invention relates to a closing mechanism, for a rotating-type capping machine, for closing the mouth portion of a bottle or other container with a crown cap or similar closure delivered from a supply container, with the closing mechanism being disposed over a bottle support and being adapted, in a vertical axis, to be lowered out of a starting position and to be raised again into this starting position. The closing mechanism has a deformation member for placing the crown cap upon the mouth portion of the bottle and for subsequently fixing the crown cap thereon via permanent deformation of the crown cap while simultaneously pressing the crown cap against the mouth portion of the bottle. The closing mechanism also has a hold-down mechanism that extends centrally through the deformation member and is spring-loaded via at least one spring, with the hold-down mechanism having a surface that faces the bottle support and is provided with a holding means for the crown cap.

A capping machine is known (U.S. Pat. No. 4,205,502) that for closing bottles with closures, namely with crown caps, has a plurality of closing mechanisms, each of which has a hold-down mechanism for placing and pressing a respective crown cap onto the mouth of the bottle that is to be closed, and also has a deformation member for fixing the crown cap on the bottle via deformation. Furthermore, the lower end of each closing mechanism that faces the bottle support is provided with a centering means having a centering opening that, starting from the lower end of the closing mechanism, has a first centering portion that narrows upwardly in a conical manner, as well as a second centering portion that adjoins the first portion and is essentially cylindrical. The bottom end of each hold-down mechanism forms a hold-down surface, and is provided with a holding means (permanent magnet) for holding a crown cap on this surface. The closing mechanisms of the known capping machine are furthermore embodied in such a way that for receiving a crown cap, each hold-down surface is disposed approximately in the same plane as the lower end of the closing mechanism or the centering means. During the process of closing a bottle, in other words during lowering of the closing mechanism out of a starting position onto the bottle that is to be closed, the hold-down mechanism with its surface and the crown cap that is held there are initially held back from the lowering centering means, so that the centering portions of the centering means are shoved over the crown cap that is held on the hold-down mechanism. In so doing, this crown cap is centered in the first conical centering portion of the centering means relative to the closing mechanism in such a way that the central axis of the crown cap is disposed coaxial with the longitudinal axis of the closing mechanism. The crown cap is subsequently fixed in this position in the second centering portion before, during further lowering of the closing mechanism, the crown cap is placed upon the mouth of the bottle that is to be closed, with the mouth region of this bottle then also being surrounded by the centering means, i.e. the mouth of the bottle is disposed in the second centering portion. Immediately following this placement, the crown cap is pressed against the mouth of the bottle via the hold-down spring that acts directly upon the hold-down mechanism as well as via the deformation of the crown cap by the deformation member.

A drawback of this heretofore known capping machine and its closing mechanisms is, among other things, that although a certain centering of the bottle that is to be closed is achieved by the centering portions of the centering means, this centering process is very imperfect since the smallest diameter of the conically tapered first centering portion, and also the diameter of the second centering portion, are somewhat greater than the outer diameter of the crown cap prior to its deformation and hence inherently greater than the outer diameter of the mouth portions of the bottles that are to be closed. Since immediately after the crown cap has been placed upon the mouth of the bottle that is to be closed, i.e. immediately after the crown cap comes to rest against the mouth of the bottle that is to be closed, the hold-down spring already becomes effective and hence presses the crown cap with a great force against the mouth of the bottle that is to be closed, an alignment of the bottle relative to the crown cap is frequently impossible, which results in a defective and unsatisfactory closure of the pertaining bottle.

A further drawback of the heretofore known capping machine and its closing mechanisms is that when looking at the overall operating cycle, the placement of the respective crown cap onto the bottle that is to be closed is effected only relatively late in the cycle, which could lead to losses of filling material or liquid due to filling material foaming up out of the bottles.

It is furthermore known (U.S. Pat. No. 5,040,354) for a capping machine having a plurality of closing elements, to provide a so-called CIP (cleaning in place) cleaning for cleaning and disinfecting the closing mechanisms, with this cleaning being provided in particular for those elements that during the closure process come into contact with the mouth portions of the bottles as well as with the closures themselves, in order to thereby achieve for the material that is dispensed into the bottles an optimum protection against contamination or bacteria, and in particular also yeast, and hence to achieve an optimum shelf life. For this cleaning process, a closure or rinsing cap is provided for each closing mechanism, with this cap, via the use of appropriate arresting means, being adapted to be placed upon the lower end of the respective closing mechanism and to again be removed, whereby after being placed on this cap closes off a rinsing chamber that is essentially formed by the centering opening as well as by the deformation member of the closing mechanism; in addition to the region of the hold-down surface of the hold-down mechanism, this rinsing chamber also encloses all other regions or surfaces that are critical with regard to cleanliness and freedom from bacteria. During the CIP cleaning, a cleaning or rinsing medium (for example rinsing liquid) then flows through this rinsing chamber. The drawback of this is that the connectors as well as the pertaining hoses or conduits for supplying and withdrawing the cleaning or rinsing medium are disposed at the lower end of the respective closing mechanism or at the centering means disposed there.

It is an object of the present invention to provide a closing mechanism that avoids the drawbacks of the known mechanisms and while providing for a simplified construction, ensures an improved functioning.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
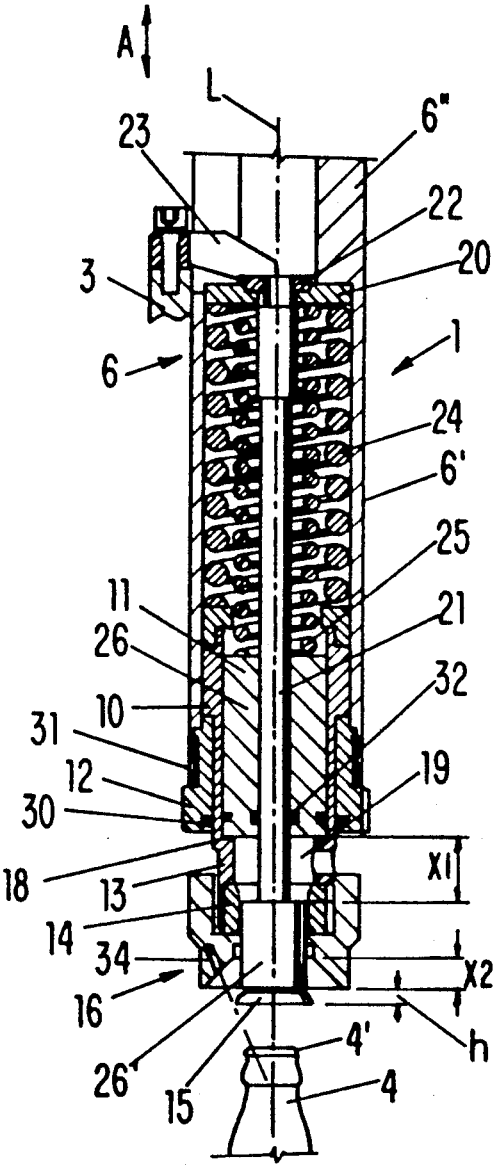
FIG. 1 is a simplified longitudinal cross-sectional view of one exemplary embodiment of an inventive closing mechanism of a rotating-type capping machine for capping bottles with closures in the form of crown caps, and also shows a part of a bottle that is to be closed.

A first specific embodiment of the inventive closing mechanism is characterized primarily by: a centering means that is provided on a lower end of the closing mechanism that faces the bottle support, with the centering means having a centering opening through which the hold-down mechanism also centrally extends, with this centering opening having at least a first centering portion that narrows upwardly in a frusto-conical manner and a second centering portion that adjoins the first centering portion on an upper side thereof and has a diameter that is somewhat greater than that of the crown cap prior to deformation thereof, whereby the bottle support permits a movement of the bottle in axial directions perpendicular to the vertical axis for alignment of the bottle; and a first closing mechanism part that cooperates with the at least one spring by being displaceable against the action thereof, with the hold-down mechanism being provided on the first closing mechanism part so as to be displaceable in the direction of the vertical axis by a prescribed free stroke such that upon placement of the crown cap on the mouth portion of the bottle and upon further lowering of the closing mechanism, the at least one spring is effective via the hold-down mechanism upon the crown cap and via the crown cap upon the mouth portion of the bottle only when the crown cap, which is already disposed on the mouth portion, is completely received by the second centering portion.

With this first specific embodiment of the present invention, the hold-down mechanism is provided on the first closing mechanism part, which cooperates with the at least one hold-down spring, in such a way that the hold-down mechanism is displaceable by a prescribed free stroke in the direction of the longitudinal axis of the closing mechanism, i.e. in the direction of the vertical axis. This inventive embodiment results in a fundamentally different manner of operation from that of the known closing mechanism and has considerable advantages thereover. During closure of a bottle, i.e. during lowering of the closing mechanism, the closure, which is preferably a crown cap, is placed upon the mouth of the bottle that is to be closed before the centering means is shoved over the closure or the mouth of the bottle. Since the closure that is held on the hold-down mechanism comes to rest against the mouth of the bottle that is to be closed with only a relatively small force that pursuant to one preferred embodiment of the invention is merely the weight of the hold-down mechanism and with another embodiment of the invention is merely the weight of the hold-down mechanism plus the force of the very soft auxiliary spring, i.e. an auxiliary spring that has a very small spring characteristic relative to that of the hold-down spring, and since this force, in conformity with the prescribed free stroke, does not initially increase despite the further lowering of the closing mechanism, the closure can center itself upon the mouth of the bottle that is to be closed and for this purpose can also shift relative to the hold-down mechanism in an axial direction perpendicular to the longitudinal axis of the closing mechanism, i.e. in the plane of the hold-down surface. After the closure has been placed upon the bottle that is to be capped, there is then effected in the centering opening of the centering means, i.e. in the centering portions thereof above the closure, also the centering or alignment of the bottle that is to be closed relative to the closing mechanism. Since the force with which the hold-down mechanism presses the closure against the mouth of the bottle is slight (essentially the weight of the hold-down mechanism, and possibly also the force of the auxiliary spring), the centering of the bottle is also possible with slight action of force, in other words can be effected gently. Only after further lowering of the closing mechanism does the hold-down spring finally become effective for pressing the closure against the mouth of the bottle; subsequently, the closure is deformed by the deformation member and is thereby fixed on the bottle. The inventive closing mechanism ensures a reliable orientation or centering of the respective closure on the bottle and also of the bottle that is provided with the closure relative to the closing mechanism. Among other things, one critical feature in this connection is that for centering the bottle that is provided with the closure relative to the closing mechanism, the bottle support permits a certain freedom of movement for the bottle, at least in the region of the mouth thereof, in axial directions that are perpendicular to the longitudinal axis of the closing mechanism. Another critical point is that during the entire centering process (centering of the closure as well as centering of the bottle), the force exerted by the hold-down mechanism remains essentially constant and corresponds to only the weight of the hold-down mechanism.

Thus, with a closing mechanism having the aforementioned inventive features, in addition to achieving a gentle and early placement of the closure upon the bottle that is to be closed, a reliable alignment or centering of the respective closure relative to the bottle that is to be closed, as well as a reliable alignment or centering of the bottle that is provided with the closure relative to the closing mechanism and the deformation member thereof, are also achieved.

A further important advantage of this embodiment of the present invention is that during closure of a bottle, the closure is placed upon the bottle already very early, i.e. already shortly after lowering of the closing mechanism out of its starting position. In this way, it is also possible to effectively prevent loss of filling material due to foaming.

With an embodiment of the present invention where the force with which the closure is pressed against the mouth of the respective bottle during centering is generated by an auxiliary spring, the hold-down spring can in principle also be embodied in such a way that during the free stroke it acts as a soft auxiliary spring, i.e. as an auxiliary spring having a small spring characteristic.

Pursuant to a further specific embodiment of the present invention, for a CIP cleaning a rinsing cap is provided for each closing mechanism. This rinsing cap is adapted to be placed upon the lower end of the closing mechanism in order to provide a closed rinsing chamber that accommodates at least the deformation member as well as the hold-down surface. To supply and/or withdraw the cleaning or rinsing medium, a channel is provided in the interior of the hold-down mechanism, which is preferably embodied as a continuous guide rod having a hold-down head. The channel opens into the rinsing chamber that is closed off by the rinsing cap via an opening; the channel also extends to the region of that end of the rod-like element or guide rod that is disposed remote from the hold-down surface, where the channel has a connector for the supply or withdrawal of the cleaning or rinsing medium. In this way, it is possible to provide at least this connection and the conduit that is connected therewith at a great distance above the bottom end of the closing mechanism.

Pursuant to a further specific embodiment of the present invention, where the rod-like element or guide rod that is provided with a hold-down head and forms the hold-down mechanism as a continuous, pass-through construction, it is proposed that this hold-down mechanism have a bore that extends in the axial direction of the hold-down mechanism, with this bore being provided for a probe that can be utilized for various control and monitoring purposes. This probe can, for example, be a probe that operates electrically, opto-electrically, or electro-acoustically, i.e. via ultrasound.

Further specific features of the present invention will be described in detail subsequently.

DESCRIPTION OF PREFERRED EMBODIMENTS

Figure 2A:
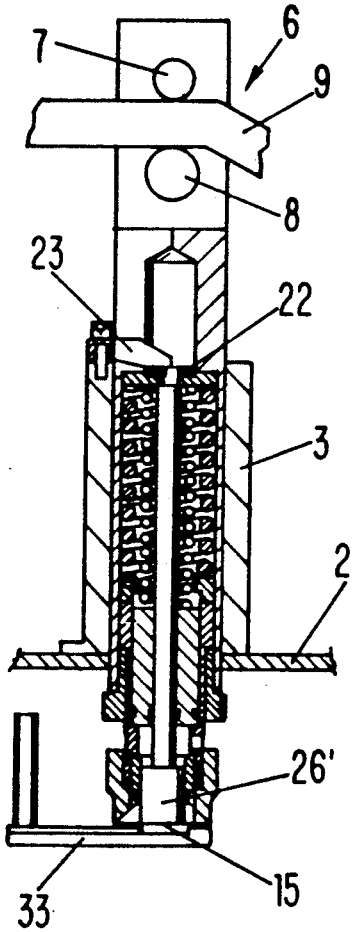
FIGS. 2*a*–2*c* show the closing mechanism of FIG. 1 in various operating positions.
Figure 2B:
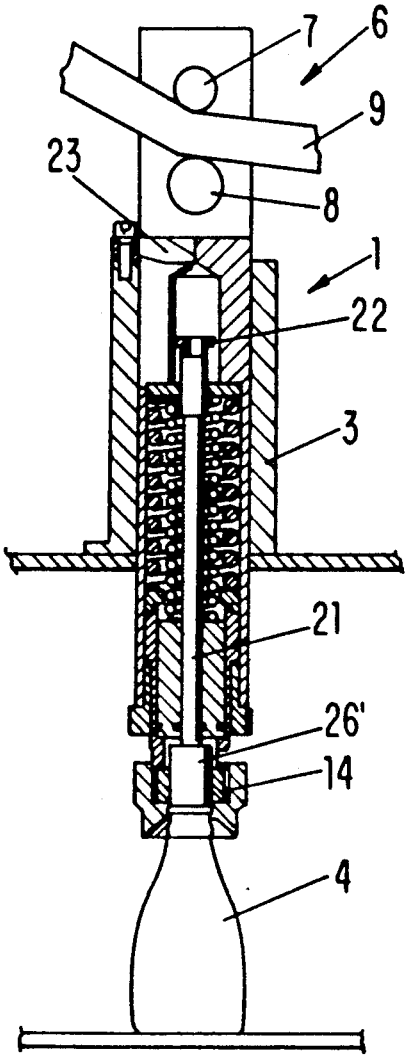
Figure 2C:
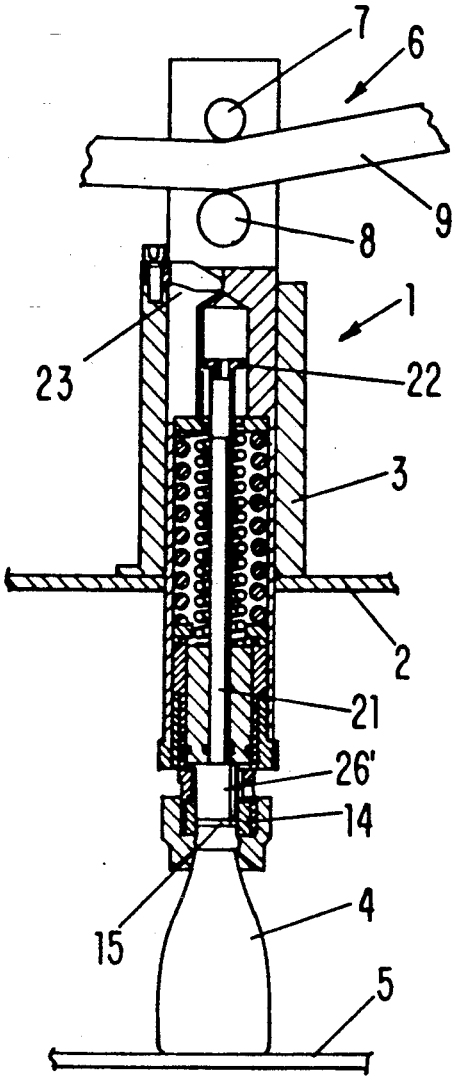
Figure 3:
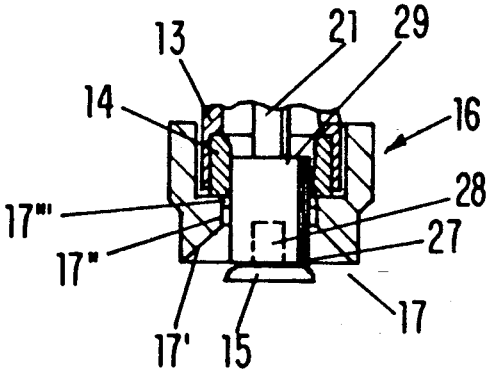
FIG. 3 is an enlarged partial view of the closing mechanism in the region of the lower end of the hold-down mechanism, the deformation member, as well as the centering means.

Referring now to the drawings in detail, in FIGS. 1 to 3 the reference numeral 1 indicates a closing mechanism of a closing or capping machine of rotating construction; only one machine part 2 that rotates about a vertical machine axis is indicated in the drawings. In reality, a plurality of closing mechanisms 1 are distributed at uniform angular spacings on the machine part 2 about the machine axis; each closing mechanism 1 is disposed in a housing guide 3 in such a way as to be displaceable in a vertical direction (the longitudinal axis L). as indicated by the double arrow A in FIG. 1.

Each closing mechanism 1 is disposed above a bottle support 5, which is provided with a support surface for the bottle or other container 4 that is to be closed or capped. Furthermore, each closing mechanism 1 comprises an outer element or housing part 6 that is guided in a vertical direction in the housing guide 3. Provided in the vicinity of the upper end of the housing part 6 are two freely rotatable guide rollers 7 and 8 that cooperate with a displacement guide means 9, which does not rotate with the machine part 2, for the up and down movement of the closing mechanism 1 (arrow A). In the illustrated embodiment, the housing part 6 has an essentially tubular or sleeve-like configuration, and is provided in the lower region with a portion 6' of greater inner cross-sectional area. Provided at the lower end of the outer housing part 6, the longitudinal axis L of which is disposed in a vertical direction, are two inner housing parts 10 and 11 that are displaceable in the direction of the longitudinal axis L. The sleeve-like housing part 10 is directly surrounded by the outer housing part 6, and in particular the portion 6' thereof, with the outer surface of the housing part 10 resting in a sliding manner against the inner surface of the portion 6'. The similarly sleeve-like housing part 11 is directly surrounded by the housing part 10, in other words, the outer surface of the housing part 11 rests against the inner surface of the housing part 10.

Via the cooperation of a shoulder provided on the outer surface of the housing part 10 with a sleeve 12 inserted into the lower, open end of the portion 6', the housing part 10 is prevented from sliding out of the housing part 6'. The housing part 10 is furthermore provided with an annular or hollow cylindrical projecting portion 13 that projects beyond the underside of the housing part 6; this projecting portion 13 is coaxial with the longitudinal axis L. In the vicinity of the lower, open end, a ring 14 is held in the interior of the sleeve-like projecting portion 13. For crown cap closing machines, the ring 14 forms the customary deformation member for the crown corks or caps 15 that are utilized to cap the bottles 4. Secured to the outer surface of the projecting portion 13 is a sleeve-like centering means 16 that projects downwardly beyond the projecting portion 13; the centering means 16 is provided with a recessed portion or centering opening 17 that is symmetrical relative to an axis that coincides with the longitudinal axis L. The centering opening 17 forms a centering portion 17' (centering cone) that is open at the underside of the centering means 16 and widens in a conical manner toward this underside; the centering opening 17 also has an adjoining, essentially circular cylindrical centering portion 17'', which is followed in a vertical direction toward the top first by third centering portions 17''' having a reduced cross-sectional area and then subsequently by the ring 14.

Since the projecting portion 13 has an inner diameter that is less than the inner diameter of the housing part 10, there is formed on the housing part 10, where it merges with the projecting portion 13, an abutment surface 18 that angularly surrounds the longitudinal axis L and is provided for the lower end face of the housing part 11. The abutment surface 18 surrounds an opening 19 via which the further inwardly disposed, annular portion of the bottom end face of the housing part 11 is freely accessible from the interior of the projecting portion 13.

A rod 21 is freely displaceably guided in the direction of the longitudinal axis L, i.e. in the vertical direction, on the housing part 11 as well as on a circular disc-shaped plate 20. The axis of the rod 21 is coaxial with the longitudinal axis L and forms part of a hold-down mechanism 26. In the starting position illustrated in FIG. 1 and in FIG. 2*a*, and which corresponds to the uppermost raised position of the closing mechanism 1, a radially projecting collar 22 of the rod 21 rests against the upper side of the plate 20 remote from the housing parts 10 and 11. Furthermore, also resting against the upper end of the rod 21 is a stop means 23 that, although it does not move along with the displacement movement of the closing mechanism 1, prevents the rod 21 from shifting axially upwardly in the starting position or uppermost displacement position of the closing mechanism. The plate 20 is held within the housing part 6 by having its peripheral region rest against an abutment that is formed at the transition zone between the portion 6' of the housing part 6 and a further portion 6'' thereof that has a reduced inner diameter. Furthermore, the upper ends of two compression springs 24 and 25 are supported against that side of the plate 20 that faces the housing parts 10 and 11. The two compression springs 24 and 25 concentrically surround the longitudinal axis L. The compression spring 25 is surrounded by the compression spring 24, the bottom end of which rests against the upper end face of the housing part 10 and, in the starting position of the closing mechanism 1 illustrated in FIG. 1, presses the housing part 10 against the abutment formed by the sleeve 12. The lower end of the compression spring 25 rests against the upper end face of the housing part 11.

The lower end of the rod 21 is provided with a punch-like hold-down head 26' that has an essentially circular cylindrical configuration, the diameter of which is greater than the diameter of the rod 21. In the vicinity of its lower circular disc-shaped end face 27, the hold-down head 26' is provided with a permanent magnet 28.

Formed at the transition zone between the rod 21 and the hold-down head 26' is an annular abutment 29 that cooperates with a counter abutment on the housing part 11, i.e. in the illustrated embodiment the lower end face of this housing part; in the starting position of the closing mechanism 1, the abutment surface 29 is spaced from the counter surface by a distance that corresponds to a free stroke xl (FIG. 1). In the illustrated embodiment, this stroke x1 is selected in such a way that the compression spring 25, which serves as a hold-down spring, does not become effective until just prior to the beginning of the deformation of the crown cap 15 by the ring 14. In any case, the stroke x1 is greater than the sum of a distance x2 and the height "h" of the crown cap 15, with x2 being the distance that the surface 27 of the hold-down head 26', in the starting position of the closing mechanism 1, has from the transition between the centering portions 17' and 17''. In the illustrated embodiment, in the starting position of the closing mechanism 1 the surface 27 is disposed approximately in the same plane as the lower end of the centering means 16.

The inner surface of the portion 6', as well as the inner and outer surfaces of the housing part 10 and 11, each form circular cylindrical slide and guide surfaces. Dirt is prevented from penetrating into the respective guides via annular sealing elements 30–32 that are provided on the sleeve 12 as well as in the lower region of the housing part 11. The sealing element 32 that is provided between the housing part 11 and the rod 21 is selected in such a way that a certain clamping or braking action is also obtained between the housing part 11 and the rod 21.

In the illustrated embodiment, the distance x1 is about 27 mm. The weight of the hold-down mechanism 26 (rod 21 including all of the components that are mounted on this rod, such as the collar 22, hold-down head 26', permanent magnet 28, etc.) is less than 3 kp and is, for example, of the order magnitude of 0.4 kp.

The inventive closing mechanism operates as follows:

With the machine part 2 rotating, at a closure feed position, i.e. at a closure feed 33 disposed there, each closing mechanism 1 receives a crown cap 15, the open side of which is then held in a downwardly directed manner at the surface 27 of the hold-down head by the permanent magnet 28. In so doing, the closing mechanism 1 is in the starting position that is illustrated in FIG. 2*a*. In this state, the closing mechanism 1 reaches the machine inlet for the bottles 4 that are to be closed, at which inlet a bottle 4 that is to be closed passes onto the bottle support 5 below the closing mechanism 1. The crown cap 15 that is held at the hold-down mechanism 26 is thereby disposed above the opening or mouth 4' of the bottle 4 that is to be closed, as illustrated in FIG. 1.

Subsequently, the closing mechanism 1, i.e. the housing part 6 with all of the elements provided thereon, is lowered, as a consequence of which the upper end of the rod 21 is released from the stop means 23, and the hold-down mechanism 26, due to its inherent weight, is lowered together with all of the remaining elements provided on the housing part 6, and in particular is lowered until the sealing side of the not yet deformed crown cap 15 rests upon the bottle 4 in the vicinity of the mouth 4' thereof. Due to the slight force with which the hold-down mechanism 26 acts against the crown cap 15, the latter can be gently and satisfactorily centered upon the mouth 4' of the bottle 4. By further lowering the closing mechanism 1, the hold-down mechanism 26, which rests against the bottle 4 via the crown cap 15, is held back; in other words, the housing parts 6, 10 and 11, and hence also the centering means 16, move further downwardly while the hold-down mechanism 26 remains stationary, so that the crown cap 15, but also the bottle 4 with its mouth 4', first pass into the conical centering portion 17'.

As the closing mechanism 1 is moved further downwardly, the crown cap 15 and the mouth 4' of the bottle 4 pass into the centering portion 17'', the diameter of which is somewhat greater than the maximum outer diameter of the not yet deformed crown cap 15, resulting in an exact centering of the crown cap 15 and the mouth 4' of the bottle 4 in the centering portion 17' relative to the longitudinal axis L such that the vertical axis of the bottle 4 coincides with this longitudinal axis L (see FIG. 2*b*). Since during this centering phase that is determined by the centering portion 17' and 17'' the force that acts between the hold-down mechanism 26 and the crown cap 15 as well as the bottle 4 merely corresponds to the inherent weight of the hold-down mechanism 26, an orientation or displacement of the bottle 4 in a horizontal axial direction is readily possible during this centering phase because (due to the slight force of the hold-down mechanism 26) the crown cap 15 can easily shift relative to the hold-down mechanism or surface 27 thereof. An additional fine centering is achieved via the centering portion 17''' when the closing mechanism 1 is moved even further downwardly.

The centering phase is terminated when, as the closing mechanism 1 is moved further downwardly, the crown cap 15 passes into the region of the ring 14 and at the same time the abutment surface 29 of the hold-down head 26' comes to rest against the bottom end face of the housing part 11.

As the closing mechanism 1 is then moved further downwardly, on the one hand the crown caps 15 are pressed firmly against the mouth 4' of the bottle 4 accompanied by compression of the springs 24 and 25, and on the other hand, via the downwardly moving ring 14, the rim of the crown cap 15 is deformed inwardly for final closure of the bottle 4 (see FIG. 2*c*).

Subsequently, the closing mechanism 1 is again moved upwardly via the displacement guide means 9, so that the closed bottle 4 is released from this closing mechanism 1, which finally again reaches the starting position illustrated in FIG. 1.

Provided on the centering means 16 are a plurality of discharge openings or jets 34 that are distributed at uniform angular spacings about the longitudinal axis L. In the illustrated embodiment, these discharge openings are disposed on the inner surface of the centering portion 17' and communicate with a non-illustrated channel for an inert gas. During closure of the bottles 4, and prior to placing the crown cap 15 upon the mouth 4' of the respective bottle 4, streams of inert gas that exit the discharge openings 34 blow air out of the bottle 4 that is to be closed and also prevent air or oxygen from entering this bottle.

Figure 4:
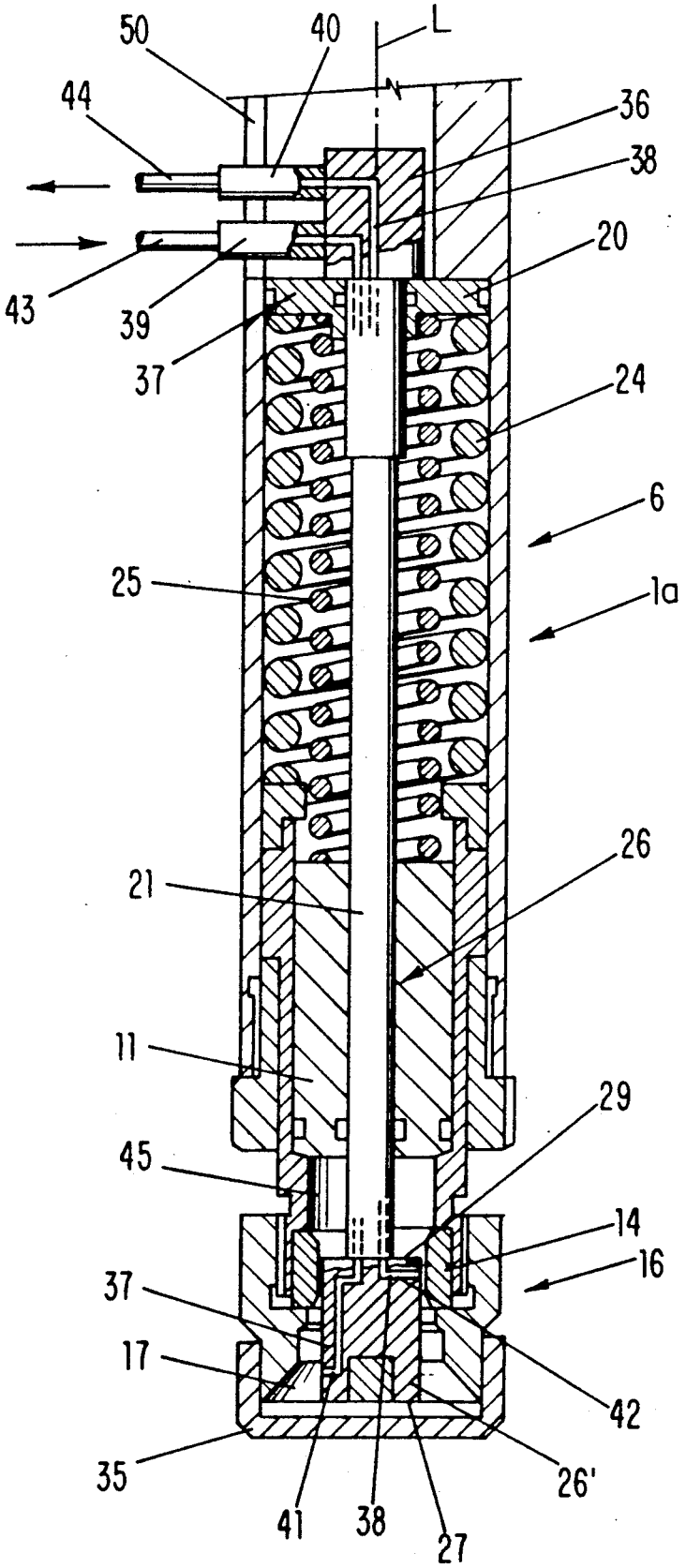
FIGS. 4 and 5 are views similar to that of FIG. 1 of two further exemplary embodiments of the inventive closing mechanism.
Figure 5:
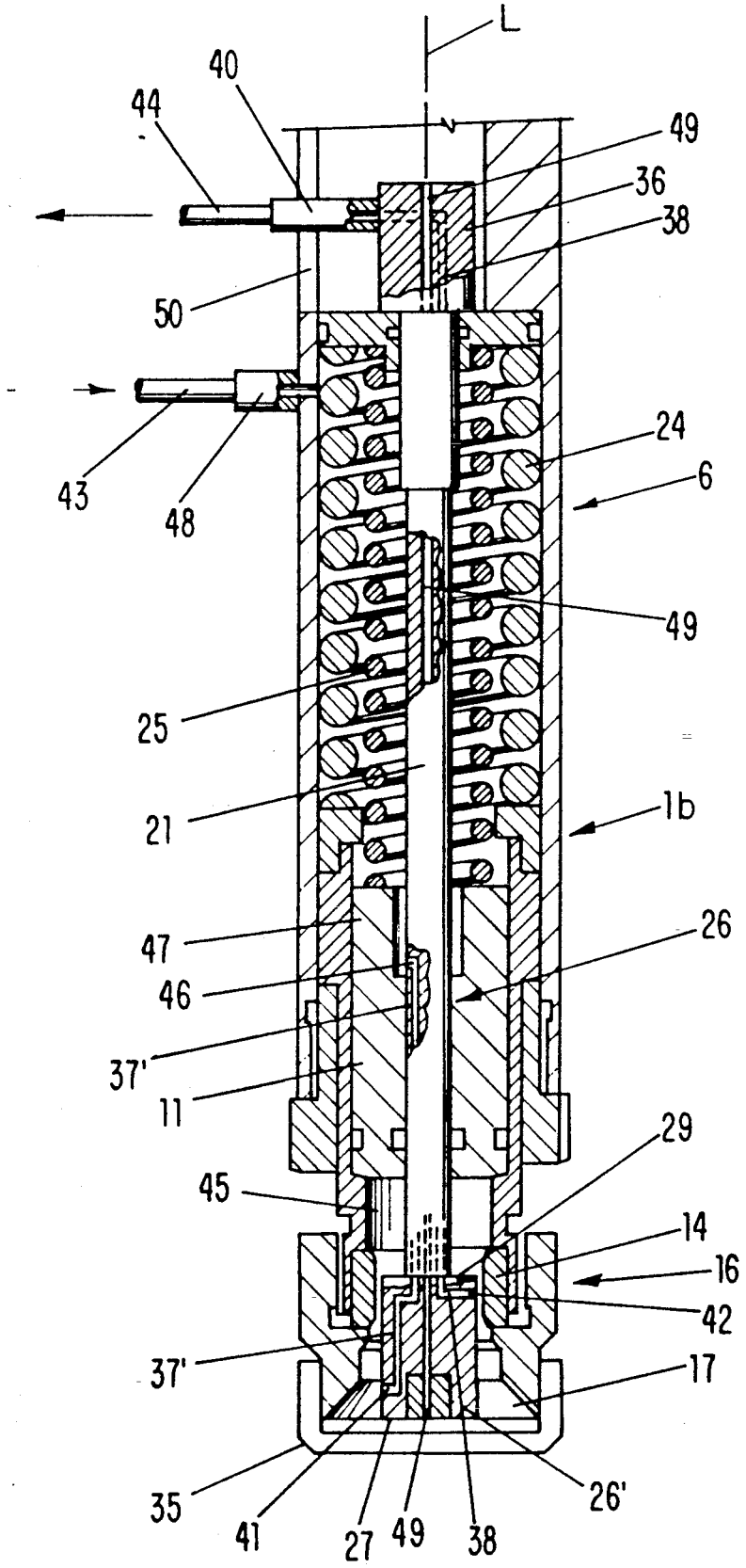

FIGS. 4 and 5 show further exemplary embodiments of inventive closing mechanisms 1*a* and 1*b* respectively that essentially correspond to the closing mechanism 1 of FIGS. 1 to 3, so that the same or corresponding elements of the embodiments of FIGS. 4 and 5 have the same reference numerals as in FIGS. 1 to 3. The two closing mechanisms 1*a* and 1*b* are designed for a CIP cleaning, where the cleaning and rinsing fluid that serves for cleaning or disinfecting such regions or surfaces of the respective closing mechanism 1*a* and 1*b* is supplied and again withdrawn in a system that is closed toward the outside.

As illustrated in FIG. 4, provided for each closing mechanism 1*a* of the closing or capping machine is a rinsing cap 35 that for the cleaning process can be placed upon the centering means 16 of the closing mechanism 1*a*, where it can be secured via non-illustrated arresting means, and in particular in such a way that after being placed on, the rinsing cap 35 tightly closes off the closing mechanism 1*a* in the vicinity of its centering opening 17.

Again with the closing mechanism 1*a*, the hold-down mechanism 26 is formed by the hold-down head 26' and the continuous rod 21, at the lower end of which the head 26' is fixedly provided, although at the upper end of the rod 21, which is guided through the plate 20, instead of being provided with the collar 22 has a head or cylindrical portion 36 that has a larger outer diameter than does the rod 21 and that in the same manner as the collar 22 determines the lower displacement position of the hold-down mechanism 26 that is possible by resting against the plate 20. Formed in the rod 21 are two separate channels 37 and 38 that extend in the axial direction of this rod; to facilitate illustration, these channels are shown only partially in FIG. 4, with the upper end of the channel 37 communicating in the region of the head or portion 36 with a connector 39, while the channel 38 communicates with a connector 40. The two channels 37 and 38 extend to the hold-down head 26', and in particular in such a way that the lower end of the channel 37 has an opening 41 at the circular cylindrical peripheral surface of the hold-down head 26' in the vicinity of the surface 27, while the lower end of the channel 38 similarly has an opening 42 at the peripheral surface of the hold-down head 26', but in the vicinity of the abutment surface or shoulder 29. It is to be understood that it is also possible that instead of only a single opening 41 and/or 42, several openings 41 and/or 42 could be distributed about the peripheral surface of the hold-down head 26'.

The connector 39 is connected to a hose or conduit 43 for supplying pressurized cleaning fluid, and the connector 40 is connected to a hose or conduit 44 for the withdrawal of this fluid. The two connectors 39 and 40 are guided out of the housing part 6 via a slot 50 that extends in the direction of the vertical longitudinal axis L and is provided in the housing part 6. With the closing mechanism 1*a*, which is secured on the rotating machine, the slot 50 is disposed on the radially inwardly disposed side of the housing part 6, i.e. the slot 50 faces the vertical axis about which the machine part 2 rotates. Thus, the conduits 43 and 44 are not only disposed by a sufficient distance above the lower end of the closing mechanism 1*a* and above the machine part 2, but rather are also disposed on a radially inner side relative to the closing mechanism 1*a* of the rotating capping machine.

If, for cleaning or rinsing the closing mechanism 1*a*, the rinsing caps are placed upon the centering means 16 and thereby the respective centering means 16 is tightly closed off against the rinsing cap 35 with the aid of at least one non-illustrated sealing means, then by actuating a non-illustrated control valve the cleaning or rinsing fluid is supplied under pressure via the conduit 43 and the channel 37. The cleaning and rinsing fluid then exits the opening 41, and in particular into the rinsing chamber, which is closed off by the rinsing cap 35 and is essentially formed by the centering opening 17, the opening of the ring 14, and the annular space 45 that is disposed thereabove and that with the closing mechanism 1*a* is closed off towards the outside. Via the pressure of the cleaning and rinsing fluid that builds up in this closed rinsing chamber, the hold-down mechanism 26 is moved upwardly in a vertical direction, so that the abutment surface 29 rests against the lower end face of the housing part 11, and the opening 42 is disposed in the immediate vicinity of this lower end face of the housing part 11. This raising or lifting is always effected if during rotation of the machine the respective closing mechanism 1*a* is lowered. Achieved in particular by the lifting is that with respect to cleanliness and freedom from germs or bacteria, all particularly critical parts, surfaces, or regions of the closing mechanism 1*a*, namely those surfaces and regions that come into contact with the crown caps 15 and/or with the mouth 4' of the bottle 4, are optimally contacted by the cleaning and rinsing fluid, which flows intensively thereabout. These regions and surfaces are in particular the surfaces of the centering opening 17, the surfaces of the ring 14, the boundary surfaces of the annular space 45, and the surfaces of the hold-down head 26'. The abutment surface 29 as well as the lower end of the rod 21 are also reached by the cleaning and rinsing fluid because the described lifting of the hold-down mechanism 26 is effected only after a sufficiently high pressure of the cleaning and rinsing fluid has built up in the interior of the rinsing chamber that is closed off by the rinsing cap 35.

The cleaning and rinsing fluid is withdrawn via the opening 42, the channel 38, and the conduit 44.

The lifting of the respective hold-down mechanism 26 can be utilized as an indicator that with the respective closing mechanism 1*a* a pressure of the rinsing or cleaning fluid has built up within the rinsing chamber that is closed off by the rinsing cap 35; in other words, the pertaining closing mechanism 1*a* is closed off by the pertaining rinsing cap 35 in the desired manner, and the cleaning of this closing mechanism has been effected as desired. Via a non-illustrated sensor, for example via a non-illustrated proximity switch, the lifting of the hold-down mechanism 26 can be monitored during cleaning or sterilization in a capping machine.

The closing mechanism 1*b* illustrated in FIG. 5 differs from the closing mechanism 1*a* essentially in that only one of the two channels, for example the channel 38 for withdrawing the cleaning and rinsing fluid, extends over the entire length of the rod 21, whereas for the supply of the cleaning and rinsing fluid, instead of the channel 37 a channel 37' is provided that at its lower end again forms the opening 41 at the hold-down head 26' in the vicinity of the surface 27, while its upper end ends in an opening 46 provided on the rod 41, and in particular in the vicinity of an annular channel 47 that surrounds the rod 41 and is formed in the housing part 11, with the lower end of this annular channel 47 being closed off, while its upper end, i.e. at the upper end face of the housing part 11, against which the compression spring 25 rests, opens out into the interior of the housing part 6, which accommodates the compression springs 24 and 25 and is closed off toward the outside. In the vicinity of the plate 20, this interior of the housing part 6 that accommodates the compression springs 24 and 25 is provided with a connector 48, to which is connected the conduit 43 for supplying the pressurized cleaning and rinsing fluid.

Thus, with the closing mechanism 1*b*, the cleaning and rinsing fluid flows via the connector 48, the interior of the housing part 6 that accommodates the compression spring 24 and 25, the opening 46, the channel 37', and the opening 41 to the rinsing chamber that is closed off by the rinsing cap 35 and that is again essentially formed by the centering opening 17, the opening of the ring 14, and the annular space 45. The cleaning and rinsing fluid leaves this rinsing chamber at the opening 42 via the channel 38 and the conduit 44 that is connected to the connector 40. Thus, with the closing mechanism 1*b* the interior of the housing part 6 that accommodates the compression springs 24 and 25, and all elements that are present there, are also cleaned. It is to be understood that with this embodiment it is also possible that rather than the supply, the withdrawal of the cleaning and rinsing fluid can be effected in the rinsing chamber that is closed off by the rinsing cap 35 and via the interior of the housing part 6 that accommodates the compression springs 24 and 25.

In FIG. 5, the reference numeral 49 designates a central bore that is coaxial with the longitudinal axis L and extends over the entire length of the rod 21, and in particular also into the hold-down head 26' and the portion 36. This bore 49, which extends between the hold-down surface 27 and the upper side of the portion 36, serves for receiving a non-illustrated probe that can serve for various control or monitoring purposes. For example, during closure of the bottles 4 this probe can monitor the presence of the respective crown cap 15, and/or during cleaning this probe can monitor the presence of the respective rinsing cap 35. Other functions are also conceivable for such a probe.

The present invention has been described with the aid of specific embodiments. It is to be understood that changes and modifications are possible while still falling within the scope of the invention. For example, the centering portion 17''' can be eliminated. Furthermore, it is also possible to embody the centering portion 17'' as a narrow cone.

The present invention is, of course, in no way restricted to the specific disclosure of the specification and drawings, but also encompasses any modifications within the scope of the appended claims.

What I claim is:

1. A closing mechanism, for a rotary-type capping machine, for capping bottles with crown caps, said closing mechanism being disposed over a bottle support and means for lowering said closing mechanism out of a starting position and raising again into said starting position by vertical movement, said closing mechanism comprising:

a deformation member for placing a crown cap on a mouth portion of a bottle and for subsequently fixing said crown cap on said mouth portion by permanent deformation;

a hold-down mechanism that extends centrally through said deformation member and cooperates with at least one spring, with said hold-down mechanism having a hold-down surface that faces said bottle support and is provided with a holding means for holding said crown cap;

a centering means for centering said crown cap before same is placed on said bottle, with said centering means being provided on a lower end of said closing mechanism, which end faces said bottle support, and with said centering means having a centering opening through which said hold-down mechanism also centrally extends, with said centering opening having at least a first centering portion that narrows upwardly in a frusto-conical manner and a second centering portion that adjoins said first centering portion on an upper side thereof, said second centering portion having a diameter greater than that of said crown cap prior to deformation thereof, whereby said bottle support is provided with means that permits a movement of said bottle in directions perpendicular to a vertical axis for alignment of said bottle relative to said centering means;

a first closing mechanism part that cooperates with said at least one spring by being displaceable against the action thereof, with said hold-down mechanism being displaceable on said first closing mechanism part and being centrally spaced from said lowering means to permit said hold-down mechanism an unrestricted upward free stroke into said space for centering said crown cap; and means for making said at least one spring effective such that upon placement of said crown cap on said mouth portion of said bottle and upon further lowering of said closing mechanism, said at least one spring is effective via said hold-down mechanism upon said crown cap and via said crown cap upon said mouth portion of said bottle only after said crown cap, which is already disposed on said mouth portion, is completely received by said second centering portion.

2. A closing mechanism according to claim 1, further comprising:

at least one rinsing cap that is detachably connectable to a lower end of said closing mechanism for closing off a rinsing chamber that is formed inside said centering opening and said deformation member;

at least one first channel having first opening means for supplying a cleaning and rinsing fluid into said rinsing chamber;

at least one second channel having second opening means for withdrawing said rinsing fluid from said rinsing chamber, with at least one of said first and second opening means being provided on said hold-down mechanism in the region of an end thereof that forms said hold-down surface, and with at least one of said first and second channels extending through said hold-down mechanism to an end thereof remote from said surface; and rinsing and cleaning fluid connectors for said first and second channels, with said connectors being disposed at said end of said hold-down mechanism that is remote from said surface thereof.

3. A closing mechanism according to claim 1, wherein said means for making said at least one spring effective are such that said hold-down mechanism rests against said crown cap, and via said crown cap against said mouth portion of said bottle, only with a force that corresponds to the weight of said hold-down mechanism until said crown cap is completely received by said second centering portion.

4. A closing mechanism according to claim 1, further comprising an auxiliary spring that acts between said first closing mechanism part and said hold-down mechanism, with said auxiliary spring having a spring characteristic that is considerably less than the spring characteristic of said at least one spring.

5. A closing mechanism according to claim 1, in which said second centering portion has an essentially circular cylindrical configuration.

6. A closing mechanism according to claim 1, in which said second centering portion is embodied as a narrow cone.

7. A closing mechanism according to claim 1, in which said second centering portion, when viewed in the direction of said vertical axis, is disposed between said first centering portion and said deformation member.

8. A closing mechanism according to claim 1, in which said centering opening has a third centering portion that is disposed between said second centering portion and said deformation member and has a smaller cross-sectional area than does said second centering portion.

9. A closing mechanism according to claim 1, in which said free stroke is at least equal to the distance between said hold-down surface of said hold-down mechanism in a lowered position thereof, and a transition between said first and second centering portions plus a height of said crown cap.

10. A closing mechanism according to claim 1, in which said hold-down mechanism has at least one abutment means that cooperates with counter-abutment means on said first closing mechanism part to limit said free stroke.

11. A closing mechanism according to claim 1, in which said hold-down mechanism comprises a rod-like element, a lower end of which or a head disposed on said lower end forms said hold-down surface, said rod-like element being displaceably guided in said first closing mechanism part.

12. A closing mechanism according to claim 1, which includes a second closing mechanism part on which is provided said deformation member and said centering means, with said first closing mechanism part being guided on said second closing mechanism part and being displaceable in said vertical axis, and with said second closing mechanism part being guided in a third closing mechanism part and being displaceable in said vertical axis against the action of a further spring.

13. A closing mechanism according to claim 1, which includes means for preventing free displacement of said hold-down mechanism in said starting position of said closing mechanism.

14. A closing mechanism according to claim 13, in which said means for preventing free displacement is formed by stop means against which said hold-down mechanism rests.

15. A closing mechanism according to claim 1, which includes at least one clamping element that is effective between said first closing mechanism part and said hold-down mechanism.

16. A closing mechanism according to claim 1, in which said hold-down mechanism has a weight of less than approximately 3 kp.

17. A closing mechanism according to claim 1, in which said deformation member is embodied as a centering means having said centering opening.

18. A closing mechanism according to claim 1, which includes at least one discharge opening means on said first centering portion for generating an inert gas stream directed at said mouth portion of said bottle that is to be closed.

19. A closing mechanism according to claim 2, in which said first opening means of said at least one first channel is provided on said hold-down mechanism.

20. A closing mechanism according to claim 19, in which said second opening means of said at least one second channel is also provided on said hold-down mechanism.

21. A closing mechanism according to claim 2, in which one of said first and second channels opens into a chamber formed with said closing mechanism and accommodating at least said at least one spring.

22. A closing mechanism according to claim 2, in which said hold-down mechanism is embodied as a continuous rod-like element or guide rod.

23. A closing mechanism according to claim 22, in which said hold-down mechanism has a central bore that communicates with said hold-down surface thereof and accommodates a probe or sensor for monitoring the presence of a crown cap or of a rinsing cap.

24. A closing mechanism according to claim 2, which includes a further closing mechanism part that is provided with a slot that extends in the direction of said vertical axis and through which extend said connectors for said first and second channels.

25. A closing mechanism according to claim 24, in which said longitudinal slot of said further closing mechanism part is disposed on a radially inner side of said closing mechanism, said inner side facing said vertical axis of rotation.

26. A closing mechanism according to claim 16, in which said hold-down mechanism has a weight of approximately 0.4 kp.

* * * * *